US011143001B2

(12) United States Patent
Keller

(10) Patent No.: US 11,143,001 B2
(45) Date of Patent: Oct. 12, 2021

(54) OPTIMAL SCREENED SUBSURFACE WELL DESIGN

(71) Applicant: Carl E. Keller, Santa Fe, NM (US)

(72) Inventor: Carl E. Keller, Santa Fe, NM (US)

( * ) Notice: Subject to any disclaimer, the term of this patent is extended or adjusted under 35 U.S.C. 154(b) by 0 days.

(21) Appl. No.: 16/895,182

(22) Filed: Jun. 8, 2020

(65) Prior Publication Data

US 2020/0386082 A1 Dec. 10, 2020

Related U.S. Application Data

(60) Provisional application No. 62/857,938, filed on Jun. 6, 2019.

(51) Int. Cl.

| | |
|---|---|
| ***E21B 43/02*** | (2006.01) |
| ***E21B 43/10*** | (2006.01) |
| ***E21B 33/138*** | (2006.01) |
| ***E21B 49/08*** | (2006.01) |
| ***E21B 7/20*** | (2006.01) |

(52) U.S. Cl.

CPC ..... *E21B 43/025* (2013.01); *E21B 7/20* (2013.01); *E21B 33/138* (2013.01); *E21B 43/10* (2013.01); *E21B 49/088* (2013.01); *E21B 49/0875* (2020.05)

(58) Field of Classification Search

CPC ..... E21B 43/025; E21B 43/04; E21B 43/08; E21B 43/10; E21B 49/0875; E21B 49/088; E21B 7/20; E21B 33/138; E02D 1/06; F16L 55/1651

See application file for complete search history.

(56) References Cited

U.S. PATENT DOCUMENTS 837,433 A * 12/1906 Swain ..... E21B 43/04 166/278
1,869,754 A * 8/1932 Kelley ..... E21B 43/08 166/235

(Continued)

OTHER PUBLICATIONS

Keller, C., "Improved Spatial Resolution in Vertical and Horizontal Holes . . . "; Remediation of Hazardous Waste Contaminated Soils; 1994; pp. 513-541; Macel Dekker, Inc.; USA.

(Continued)

*Primary Examiner* — Jennifer H Gay
(74) *Attorney, Agent, or Firm* — Rod D. Baker

(57) ABSTRACT

A method and system for supporting unstable geologic materials surrounding a borehole after the borehole is drilled, while reducing the vertical migration in a sand pack behind a slotted screen in the casing. An annulus is defined between a drill casing and a continuous screened casing. Alternating sand fills and sealing layers are deposed in the annulus along a length of the borehole. The length of the sealed interval between the screened casing and the hole wall is reduced, allowing flow connection between the surrounding geologic formation and the interior of the casing over most of the casing length. The sand pack design between the screen and the borehole wall has a sufficient number of sealed barriers to vertical flow to approximate an ideal sand backpacking, which has a vertical conductivity no greater than that of the formation and a relatively low impedance to horizontal flow through the sand pack.

15 Claims, 9 Drawing Sheets

(56) References Cited

U.S. PATENT DOCUMENTS

| | | | | | |
|---|---|---|---|---|---|
| 2,597,554 | A * | 5/1952 | West | E21B 43/04 | 166/278 |
| 2,646,129 | A * | 7/1953 | Dunn | E21B 43/10 | 166/278 |
| 4,548,266 | A * | 10/1985 | Burklund | E21B 33/13 | 166/242.6 |
| 4,778,553 | A | 10/1988 | Wood | | |
| 5,078,212 | A * | 1/1992 | Boyle | E21B 43/04 | 166/278 |
| 5,176,207 | A | 1/1993 | Keller | | |
| 5,246,862 | A | 9/1993 | Grey et al. | | |
| 5,309,994 | A * | 5/1994 | Douglas | E21B 43/082 | 166/228 |
| 5,327,981 | A * | 7/1994 | Morgan | E02D 1/06 | 166/162 |
| 5,377,754 | A | 1/1995 | Keller | | |
| 5,725,055 | A | 3/1998 | Schirmer | | |
| 5,803,666 | A | 9/1998 | Keller | | |
| 5,804,743 | A * | 9/1998 | Vroblesky | E02D 1/06 | 166/264 |
| 5,853,049 | A | 12/1998 | Keller | | |
| 6,026,900 | A | 2/2000 | Keller | | |
| 6,109,828 | A | 8/2000 | Keller | | |
| 6,244,846 | B1 | 6/2001 | Keller | | |
| 6,283,209 | B1 | 9/2001 | Keller | | |
| 6,298,920 | B1 * | 10/2001 | Keller | E21B 19/00 | 166/377 |
| 6,298,925 | B1 * | 10/2001 | Lee | E21B 7/205 | 166/264 |
| 6,910,374 | B2 | 6/2005 | Keller | | |
| 7,281,422 | B2 | 10/2007 | Keller | | |
| 7,753,120 | B2 | 7/2010 | Keller | | |
| 7,841,405 | B2 | 11/2010 | Keller | | |
| 7,896,578 | B2 | 3/2011 | Keller | | |
| 8,069,715 | B2 | 12/2011 | Keller | | |
| 8,176,977 | B2 | 5/2012 | Keller | | |
| 8,424,377 | B2 | 4/2013 | Keller | | |
| 9,008,971 | B2 | 4/2015 | Keller | | |
| 9,534,477 | B2 | 1/2017 | Keller | | |
| 9,797,227 | B2 | 10/2017 | Keller | | |
| 10,030,486 | B1 | 7/2018 | Keller | | |
| 10,060,252 | B1 | 8/2018 | Keller | | |
| 10,139,262 | B2 | 11/2018 | Keller | | |
| 10,337,314 | B2 | 7/2019 | Keller | | |
| 10,472,931 | B1 | 11/2019 | Keller | | |
| 2012/0173148 | A1 | 7/2012 | Keller | | |
| 2016/0348482 | A1 * | 12/2016 | Keller | E21B 49/084 | |
| 2020/0232292 | A1 * | 7/2020 | Keller | E21B 23/01 | |
| 2020/0386082 | A1 * | 12/2020 | Keller | E21B 49/088 | |

OTHER PUBLICATIONS

Cherry, J.A., et al.; "A New Depth-Discrete Multilevel Monitoring Approach for Fractured Rock"; Ground Water Monitoring & Remediation; 2007; pp. 57-70; vol. 27, No. 2; USA.

* cited by examiner

OPTIMAL SCREENED SUBSURFACE WELL DESIGN

CROSS REFERENCE TO RELATED APPLICATIONS

This application claims priority to and the benefit of the filing of U.S. Provisional Patent Application Ser. No. 62/857,938 entitled "Optimal Screened Subsurface Well Design," filed 6 Jun. 2019, the entire disclosure of which is incorporated herein by reference.

BACKGROUND OF THE INVENTION

Field of the Invention

This invention relates generally to multi-level water sampling systems within underground boreholes, and more particularly to pore fluid sampling, conductivity measurements, and other similar uses for flexible borehole liners, and specifically to a system, employing a flexible borehole liner, for mapping of ground water contaminant distributions.

Background Art

Beneficial reference may be had to U.S. Pat. Nos. 8,424,377, 7,753,120, 6,910,374, and 6,283,209 for background information for the present invention. These patents are incorporated herein by reference.

Flexible liners have been used for many hydrologic measurements in open stable (i.e., resistant to collapse) boreholes, often drilled in fractured rock formations. The open stable hole is the preferred site for flexible borehole liner installations, but the same type of liner systems has been installed through continuous-driven casing, followed by withdrawal of the casing, in unstable sediments. In such circumstances, the inflated liner supports the open borehole wall in the unstable formation. However, upon withdrawal of the flexible liner, often by inverting the liner back up the borehole, the borehole usually collapses.

A common practice in unstable formations is to install a rigid casing with one or more screen intervals for access to the formation pore fluids. To keep loose sand and gravel from collapsing into the borehole, it is necessary to use well casing and screen. The screen supports the borehole walls while allowing water to enter the well; unslotted casing is placed above (and possibly below) the screen to keep the rest of the borehole open and serve as a housing for pumping equipment. Well screens should have as large a percentage of non-clogging slots as possible, be resistant to corrosion, have sufficient strength to resist collapse, be easily developed and prevent sand pumping. These characteristics are best met in commercial continuous-slot (e.g., wire wrap) screens. Herein, "screened casing" refers to the length or interval of a casing, and potentially the complete length of casing, that is slotted or drilled to permit fluid flow therethough. Selection of the optimum location for such screened intervals is more difficult than in open stable boreholes, because of the inability to thoroughly assess the contaminant distribution, and the conductive intervals, prior to casing and screens installation.

In an open stable borehole, the contaminant distribution can be mapped using one of several possible methods using a flexible liner (known in my previous patents) which produces stains upon contact with a NAPL, or by the method of pressing an activated carbon felt against the borehole wall with a flexible liner for a continuous map of the dissolved phase distribution. (Non-aqueous phase liquids, or NAPLs, are liquid solution contaminants that do not dissolve in or easily mix with water.) Another flexible liner method maps the conductivity distribution in an open stable borehole. Another known liner method maps the head distribution in an open borehole.

An important factor for use of these known methods is the open stable borehole. Unfortunately, the typical screened casing, necessary to support the hole wall in an unstable formation, blocks access to the surrounding geologic formation of interest everywhere a screen is not incorporated in the casing. A permeable sand fill or "sand pack" is usually placed behind (i.e., outside) the screened intervals of the casing to allow extraction of fluids from formation media adjacent to the screened interval. Between the screened intervals in the casing, the fill material between the casing and the hole wall is a sealant (such as grout) used to prevent contaminated water migration vertically between the casing and the borehole wall. This is important to prevent the vertical migration of ground water contaminants, which may compromise sampling integrity.

An obvious mode for improved formation fluids access would be to deploy a casing with a continuous screen, e.g., a "casing" made of a screen. The screen and backfill thus support the unstable formation. However, water flow both inside the casing and in the sand pack is not to be permitted, to avoid cross-contaminations, as explained above. A flexible liner sealing the interior of a continuous screen is a simple plausible solution for sealing that path, but the surrounding permeable sand-filled annulus is still objectionable, due to the potential for compromising sampling integrity. The ideal sand pack accordingly would have a high horizontal conductivity (to permit ready sampling), but a very low vertical conductivity (to minimize vertical cross-contaminations). Such a packing would allow ideal access to the formation pore fluids and, combined with a sealing liner, would prevent contaminant migration. The present invention is a system and method for constructing an approximation to such an ideal, but hypothetical, sand pack, to allow the above list of flexible liner methods to be used to measure the hydraulic characteristics of the formation behind the sand fill of a relatively unstable borehole.

SUMMARY OF THE INVENTION

There is disclosed hereby a method and system for supporting unstable geologic materials surrounding a borehole after the borehole is drilled. The invention allows easy access to the unstable formation, but avoids the undesirable associated vertical migration of contaminated formation fluids. A further benefit of the invention is to allow access for use of well-tested measurements to be extended from open boreholes in stable formations to boreholes in unstable formations which ordinarily would collapse if not supported by a casing or inflated liner.

There is disclosed a method and system for greatly reducing the vertical migration in the normal sand pack behind a slotted screen in the casing. A slotted screen is specified, as is commonly found with PVC screens, which have no vertical flow path within the wall of the slotted casing. (The use of wire-wrapped screens is unattractive with this method.) A generally summarized concept of the invention is to reduce, from the major portion of the borehole vertical length to only a small percentage of the borehole length, the length of the sealed interval between the casing and the hole wall—thereby allowing flow connection between the surrounding geologic formation and the interior of the casing over most of the casing length.

The invention employs a casing formed of continuous screened intervals. This sand pack design between the screen and the borehole wall has a sufficient number of barriers to vertical flow that it approximates the ideal sand backpacking, which has a vertical conductivity no greater than that of the formation and a relatively low impedance to horizontal flow through the sand pack.

Advantageously, a very fine-grained sand pack with small lateral (e.g. radial in the borehole) thickness in a thin annulus between the casing and hole wall is attractive as having low horizontal impedance and higher resistance to vertical flow, as compared to the flow through a large laterally nearby surface in the formation. The realized objective is a relatively insignificant contribution to vertical migration of contaminants which would allow intermingling of different aquifers due to flow in the sand pack. Zero flow in the annulus is not necessary. (However, the very fine-grained sand pack may allow sand flow through the screen and may not yet be of a sufficiently low conductivity.) The interior of the casing is easily sealed with a flexible liner, according to known techniques, employing a wide variety of measurement devices used in open stable boreholes.

The method and system described hereafter is one of several modes and means for sealing the annular sand pack either during the construction of the well, or an alternative method after construction of the well. But the several methods described beneficially produce a sand pack with much higher lateral conductivity than vertical conductivity, advantageously to facilitate a variety of useful measurement of formation characteristics in unstable sediments or unstable bedrock wells using devices inside the screened casing. This reduces greatly the uncertainty of selection of the most important hydrologic features, such as more conductive (aquifers) or least conductive (e.g., aquitards), and contaminated or uncontaminated intervals.

Finally, a variation of the disclosed method seals the sand pack partially or entirely after the initial investigation is complete, if desired. Also advantageously, the present system and method allow identification of the best intervals for subsequent sealing of the sand pack. In that respect, the design can revert to the equivalent of a cased hole with a few essential screened intervals. The same continuous screen allows injection of remediation fluids in the intervals discovered.

BRIEF DESCRIPTION OF THE DRAWINGS

The accompanying drawings, which are incorporated in and form a part of the specification, illustrate embodiments of the present invention and, together with the written description, serve to explain and enable the invention. In the drawings.

The drawings are not necessarily to scale, either within a single view or between views.

DETAILED DESCRIPTION OF A PREFERRED EMBODIMENT

Figure 1:
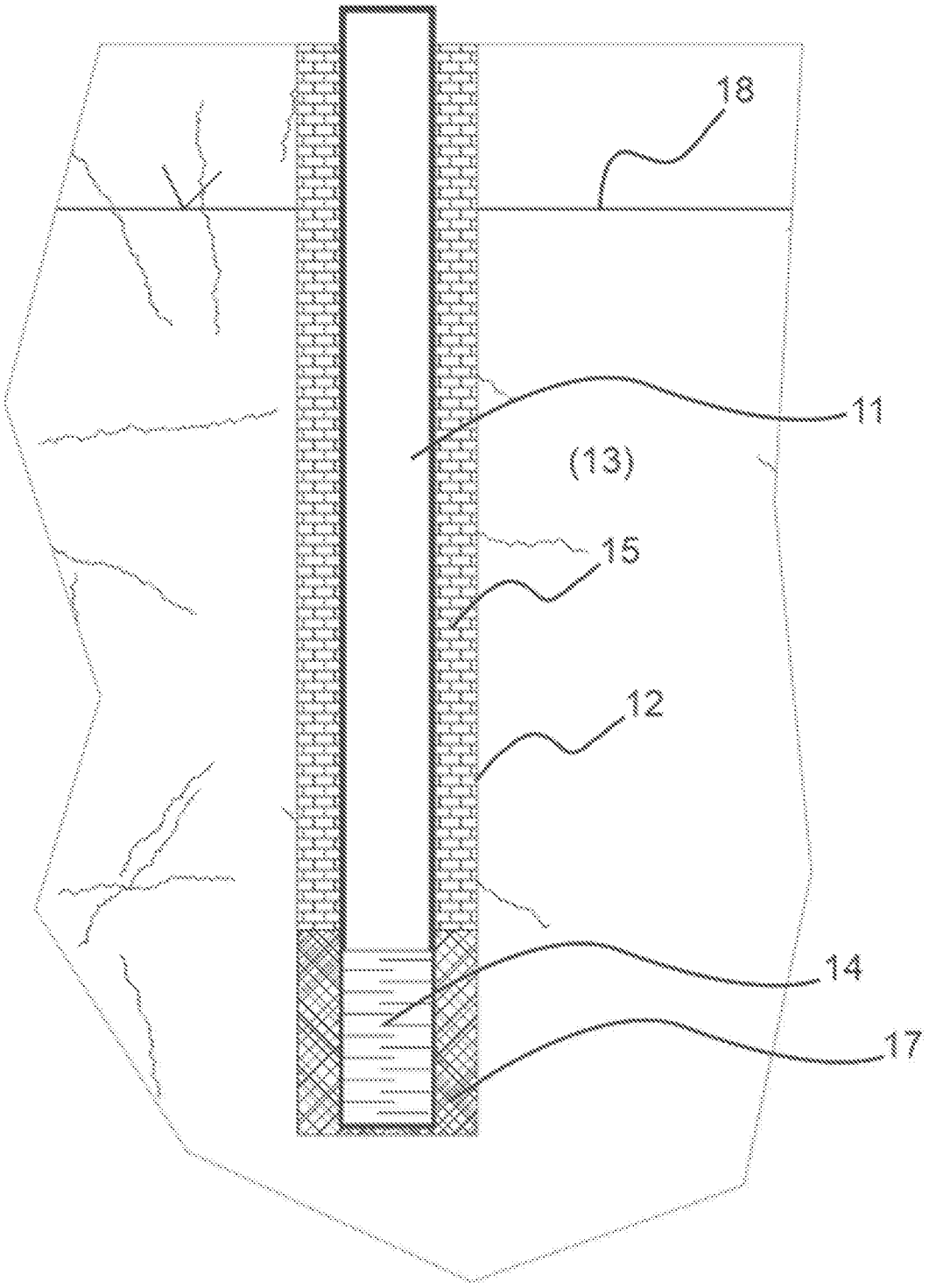
Fig. 1 (Prior Art)
FIG. 1 is a diagrammatic side cross-sectional view of a common or known screened well or borehole.

A traditional and typical borehole well for collection of water samples for analysis is shown in FIG. 1. It includes a casing 11 set in a walled borehole 12 in a surrounding subsurface geologic formation 13. At the bottom end of the casing 11 is a permeable casing section 14 called a "screen," which may be perforated with holes or slots cut through the casing section to allow water flow from the formation 13, through the casing, and into interior of the casing 11. The annular space 15 between the casing 11 and the borehole wall 12 is filled with a sealing material (e.g., a grout) above the screen 14 (i.e., higher in the borehole than the screen), and with sand 17 in the space between the screen section 14 and the hole wall 12. The slots of the casing screen 14 are smaller than the particles of sand 17 to prevent the sand 17 flowing into the interior of the casing 11. A water sample is obtained from the interval of the screen 14 by emplacing a pump (not shown) below the water table 18 and within the interior of casing 11. The pump draws water from the formation 13 only in the vicinity of the screened interval 14.

Figure 2:
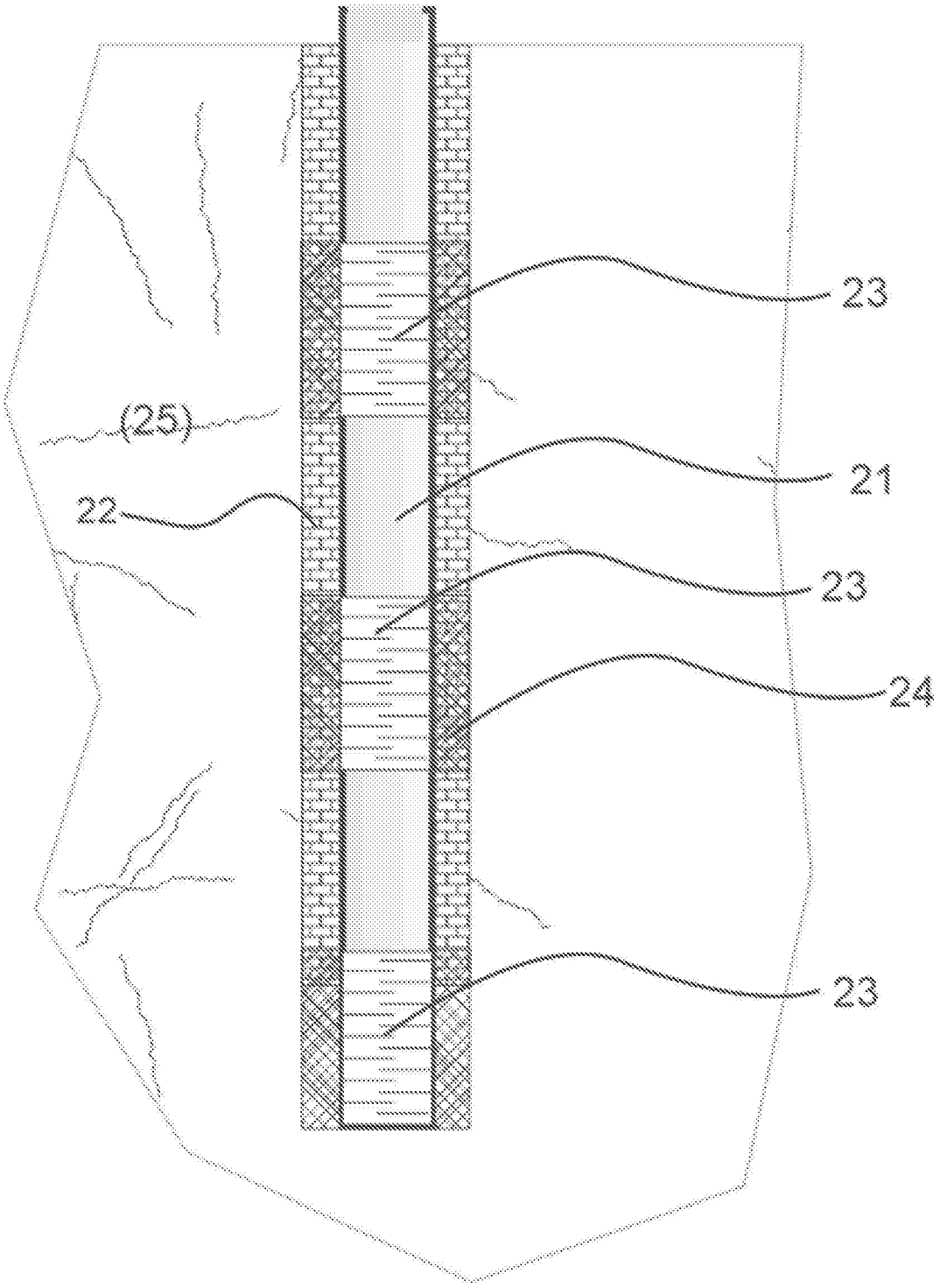
Fig. 2 (Prior Art)
FIG. 2 is a diagrammatic side sectional view of a multiple-screened well or borehole.

A second known design is shown in FIG. 2, which includes a casing 21 with several screens 23. The annular spaces 22 situated vertically between adjacent screens 23 are filled with a sealing material such as grout. The annular spaces 24 around and adjacent the screens 23 are filled with sand to allow access to the fluids in the formation 25; but the pumping from the interior of the casing 21 must be done with the interior of the casing 21 sealed between the screens 23 by some means such as commonly known straddle packers. A common device for that purpose is a WESTBAY packer (not shown), available from Westbay Instruments, of Burnaby, British Columbia, Canada. Such a design seals the interior of the casing 21 and allows water extraction respectively at each of the several screens 23. Another method seals the interior of the casing 21 with a specialized flexible liner and allows water samples to be drawn from each of the screens 23. However, this approach is still limited to the measurements of the formation fluids at the screened intervals around the screens 23 only. A problem is to determine where to position the screens 23 for pore fluid samples.

Figure 3:
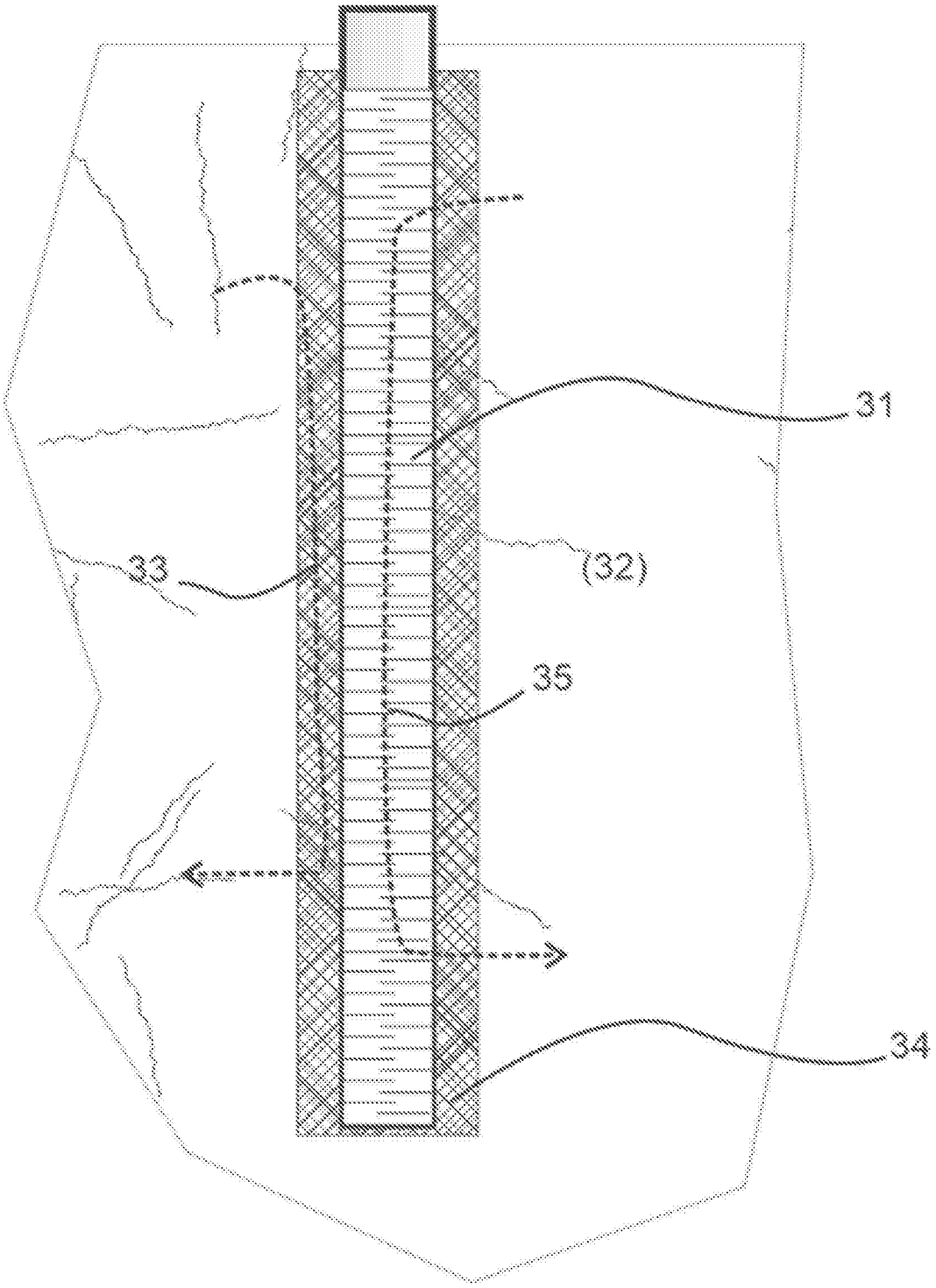
FIG. 3 is a schematic side sectional view of the flow field in a continuously screened well, illustrating the problem addressed by the present invention.

FIG. 3 depicts a proposed extension of the screen 31 to and along the full length of the bore casing to allow access for sampling vertically the pore fluids from the surrounding formation 32. However, outside fluid flow 33 in the permeable annular sand pack 34, and inside fluid flow 35 within the open casing, allow deleterious vertical migration of contaminants and undesired spreading of contaminated ground water to uncontaminated intervals in the formation 32. Sealing the interior of the screened casing 31 does not address the problematic vertical flow 33 that can occur in the sand-filled annulus 34.

Figure 4:
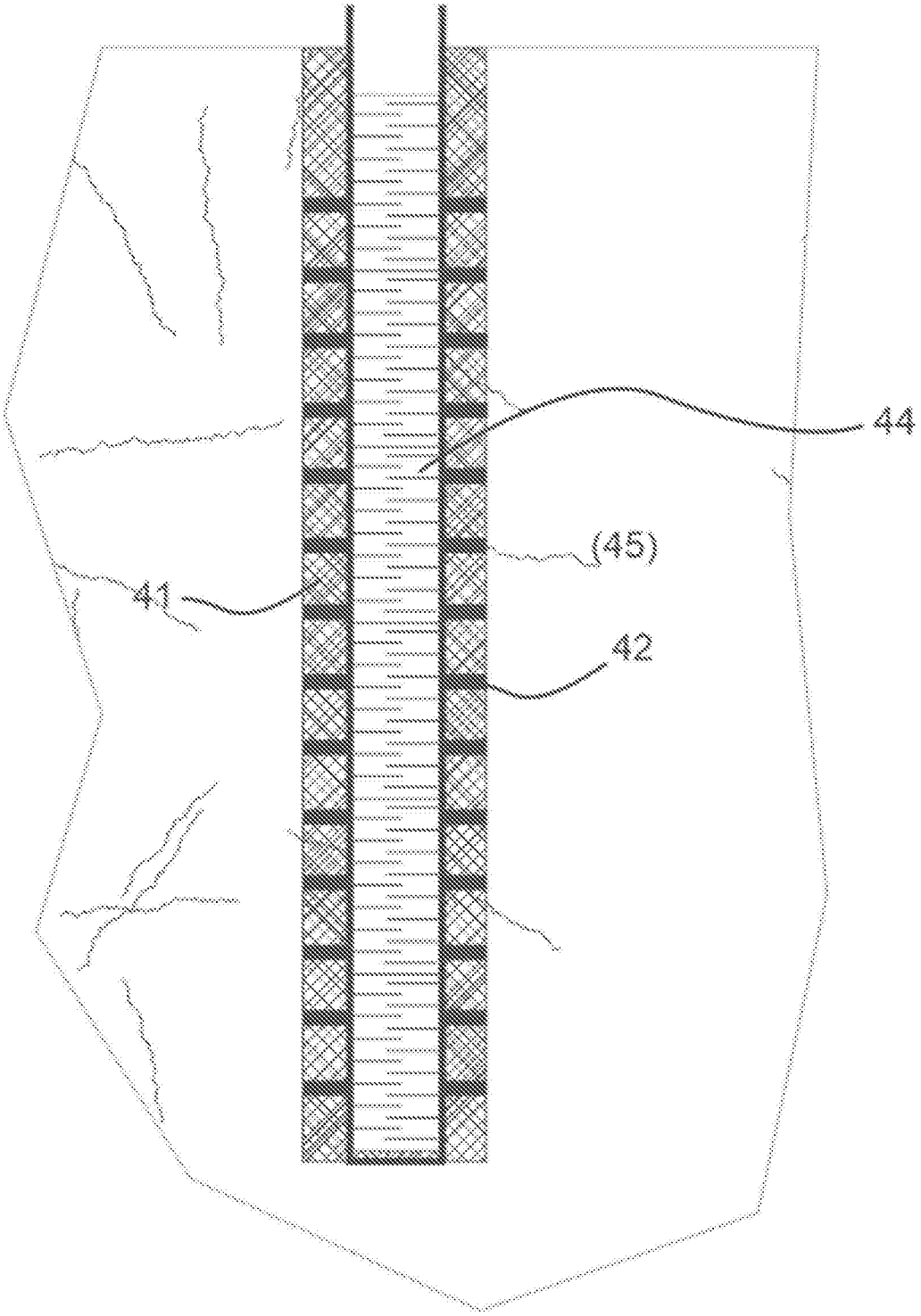
FIG. 4 is a side sectional view of an embodiment of the continuous screen with multiple sealing layers system, in the sand filled annulus, according to the present disclosure.

FIG. 4 illustrates a continuous screened casing 44 (similar to that seen in FIG. 3), but the sand filled annulus 41 has numerous vertically discrete intervals in the annulus, the intervals separated by a plurality of sealing layers of separation seals 42. These separation seals 42 in the sand filled annulus 41 greatly reduce the conductivity for vertical flow in the annulus 41. Combined with a continuous seal of the interior of the casing 44 by means of a flexible liner (not shown) inside the casing 44, there is minimal concern with vertical fluid migration in the annulus 41. The plurality of separation seals 42 in the annulus 41 can be bypassed by flow in the formation 45, but with sufficiently many sealing layers 42 the bypass is limited to insignificant and tolerable. Any vertical migration in the sand filled annulus 41 preferably is less than that in the nearby formation 45.

Figure 5A:
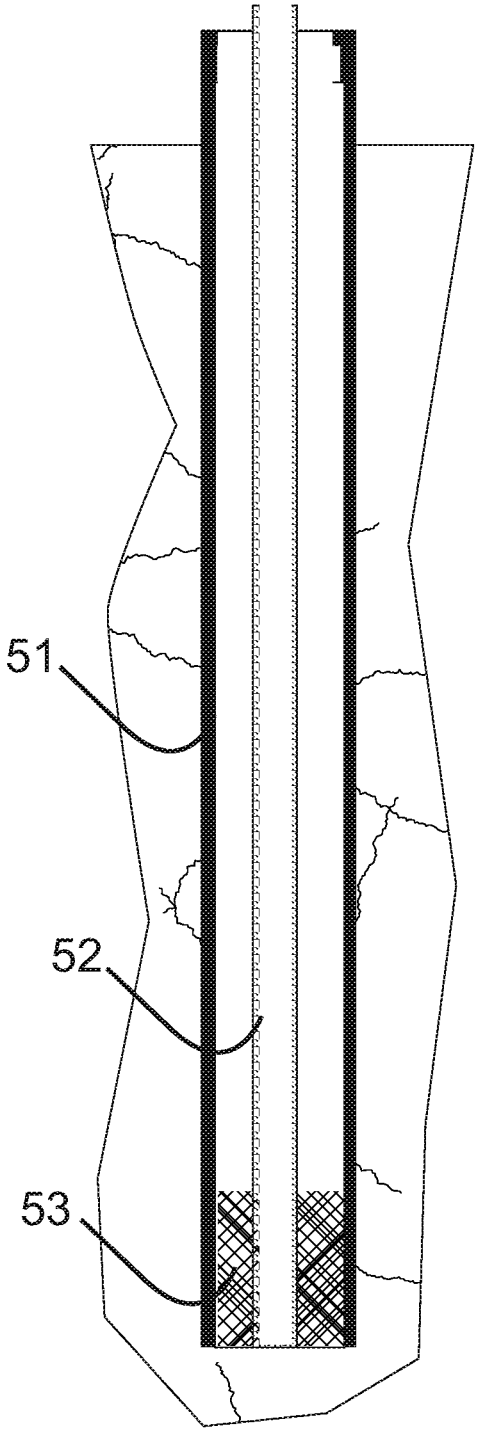
FIG. 5A provides a schematic side sectional view of an interrupted sand pack system, near the beginning of the emplacement in a driven-casing well, according to the present invention.
Figure 5B:
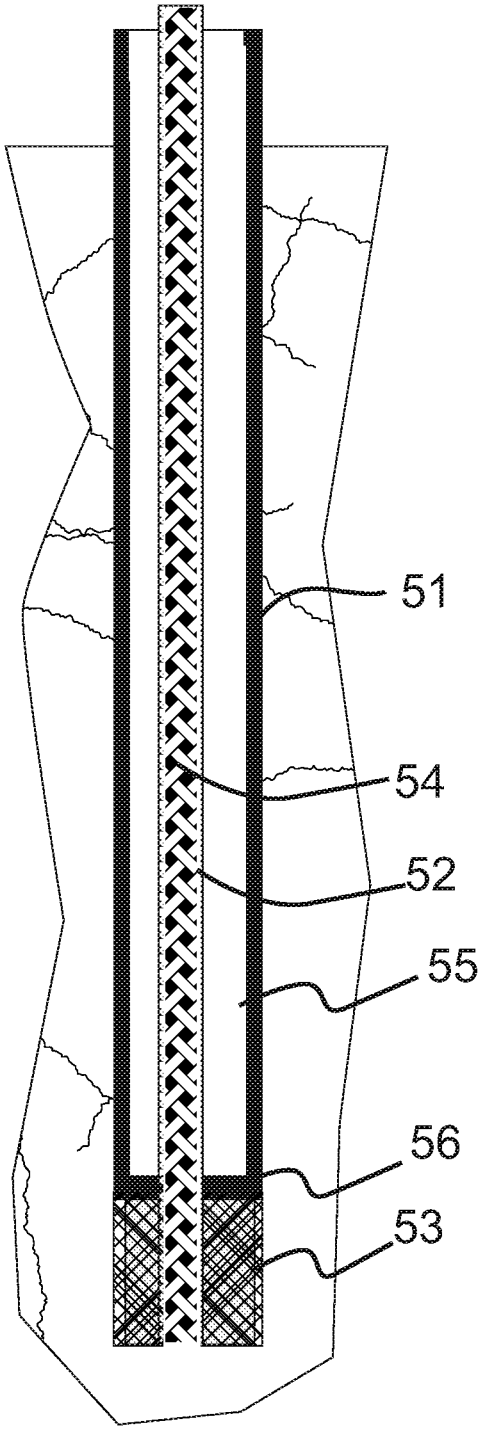
FIG. 5B provides a schematic side sectional view of an interrupted sand pack system, at an intermediate step of an emplacement in a driven-casing well, according to the present invention.
Figure 5C:
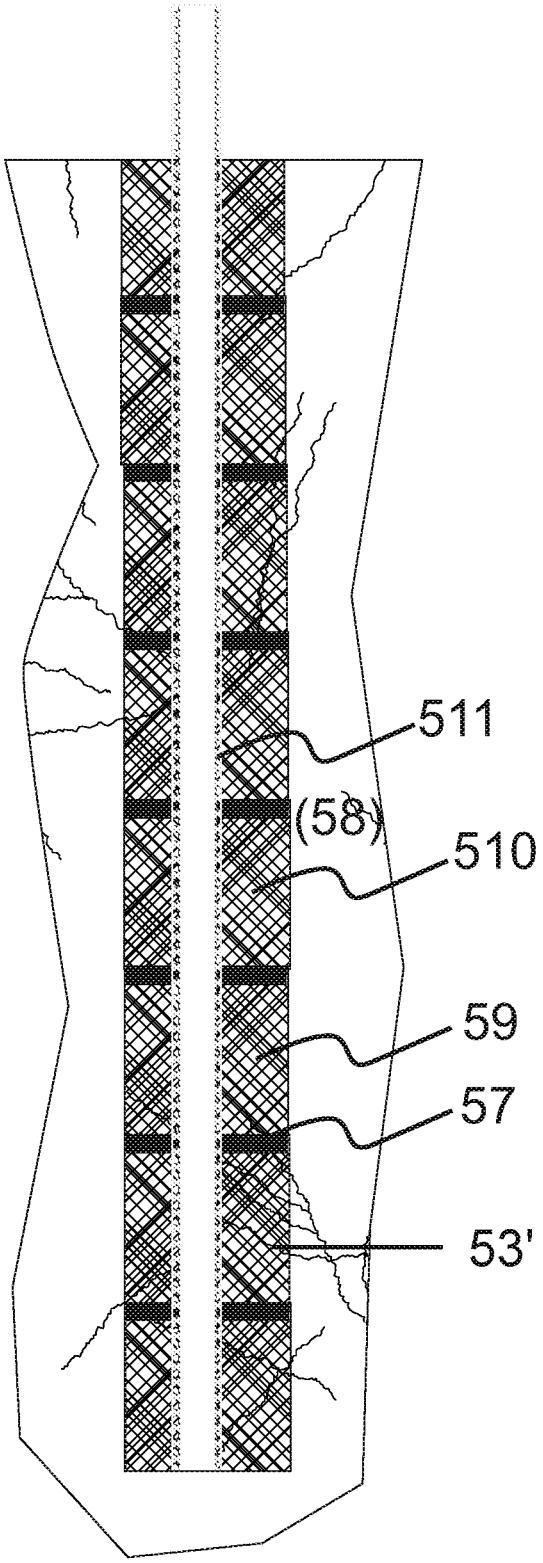
FIG. 5C provides a schematic side sectional view of an interrupted sand pack system, at a later step of an emplacement in a driven-casing well, according to the present invention.

A means or mode for installing the sealing intervals is illustrated by combined reference to FIGS. 5A-C. In the figure FIG. 5A, a sonic-driven rigid tubular drill casing 51 is driven into the subsurface to form and define the borehole. All the material (e.g., geologic media) inside the drill casing 51 is then removed to allow a continuous screened casing 52 to be lowered down the borehole and into the interior of the drill casing 51. A first sand fill 53, preferably of a length (height) at least equal to or somewhat greater than the length of a segment of the drill casing 51, is deposited at the bottom of the borehole, in the annulus 55 between the drill casing 51 and the screened casing 52, as also indicated in FIG. 5A. (The drill casing 51 is composed of a series of casing segments, the segments connected end-to-end according to convention and normally having generally equal lengths (e.g., approximately ten feet.) The drill casing 51 is then withdrawn upward an incremental distance (i.e., preferably a distance corresponding approximately to, or modestly less than, the length of one drill casing segment—again, typically about 10 feet). The sand fill 53 preferably is sufficient that when the drill casing 51 is withdrawn incrementally and the sand moves laterally to fill the void left by the casing removal, that the sand level is near the bottom of the casing section after withdrawal of one drill casing segment.

Referring next to FIG. 5B, a flexible liner 54 is then installed down into and along the interior the screened casing 52, in contact therewith to seal the interior of the screened casing. This installation may be by everting the liner down the screened casing. A first layer of sealing material 56 (e.g., grout) is then emplaced upon the top of the first sand fill 53 and within the annulus 55 between the drill casing 51 and the screened casing 52. Another (second) additional sand fill 53' is then emplaced inside the drill casing 51, on top of the first, underlying, layer of sealing material 56. Like the first sand fill 53, the second 53' and subsequent other sand fills (e.g., another sand fills 59, 510 in FIG. 5C) preferably have a height, immediately after being deposited, slightly greater than the length of a drill casing segment. Referring jointly to FIGS. 5B and 5C, the drill casing 51 is again withdrawn upward another (second) incremental distance (e.g., corresponding to a drill casing segment length), and a second substantial layer of sealing material 57 (FIG. 5C) is emplaced in the annulus 55 between the drill casing 51 and the screen 52, and upon the upper surface of the second sand fill 53'. Each layer of sealing material 56, 57, invades the pore space in each sand fill 53, 53' for a short distance, due to the viscosity of the sealing material (grout). Sealing material also flows into the slots in the screened casing 52—but not into the interior of the screened casing due to the presence of the sealing liner 54 therein, which prevents passage of sealing material. Some sealing material may flow into the surrounding formation 58, sealing the formation for a short distance outward from the borehole wall. The flexible liner 54, which is against the inside wall of the screened casing 52, prevents any flow of sealing material 56, 57, into the interior of the screened interval. By a series of such steps, therefore, alternating layers of sand fill and sealing material are stacked from the bottom of the borehole, and around the outside of the screened casing, to a preselected height within the borehole, usually to its top.

Accordingly, the foregoing steps are serially repeated to provide a series of alternating layers of sand fill and sealing material, as shown in FIG. 5C. Thus, before each instance that the drill casing 51 is periodically lifted an incremental distance, a sand fill 53' is deposited. And after each incremental withdrawal of the drill casing 51, another layer of sealing material 57 is emplaced upon the top surface of the previously deposited sand fill. Subsequently and serially, another sand fill is deposited on another underlying layer of sealing material. Subsequent another sand fills 59, as shown in FIG. 5C, allow the added sand to settle into the underlying sealing material 57, further driving the sealing material (again, ordinarily a grout) into the formation 58 and the nearby annulus 55. After alternating layers of sealing material and sand fill have been stacked to the desired height within the borehole—typically to the top of the borehole—the flexible liner 54 is withdrawn from the screened casing 52, leaving the unlined screened casing in place within the borehole. FIG. 5C depicts a completed well design, with annular seals of the sand fill after the flexible liner 54 interior to the casing 52 has been withdrawn.

In brief summary, therefore, a method according to the present disclosure includes basic steps of: (a) driving a drill casing 51 into the subsurface 58 of the ground to form and define a borehole; (b) removing material (at least some, preferably all) from the interior of the drill casing 51; (c) lowering a screened casing 52 into the interior of the drill casing 51; (d) depositing a first sand fill 53 at the bottom of the borehole and in the annulus 55 between the drill casing 51 and the screened casing 52; (e) withdrawing the drill casing 51 upward a first incremental distance; (f) installing (optionally by eversion) a flexible liner 54 down and along the interior of the screened casing 52 to seal temporarily the inside wall of the screened casing; (g) emplacing a first layer of sealing material 56 upon the first sand fill 53 and within the annulus 55 between the drill casing 51 and the screened casing 52; (h) depositing another additional sand fill 53' in the annulus 55 between the drill casing 51 and the screened casing 52, and upon the underlying (in the first iteration, the first) layer of sealing material 56; (i) withdrawing the drill casing 51 upward another incremental distance; (j) emplacing another layer of sealing material 56 upon the another sand fill 53' and within the annulus 55 between the drill casing 51 and the screened casing 52; (k) repeating steps (h)-(j) a sufficient number of iterations to substantially fill, with alternating layers of sand fill and sealing material, and to a desired predetermined elevation within the borehole, the annulus 55 between the drill casing 51 and the screened casing 52; and (1) extracting (e.g., by inversion) the flexible liner 54 from within the screened casing 52 to leaving the unlined screened casing in place within the borehole. Ambient fluids, such as ground water, may then be permitted to flow radially inward from the surrounding formation 58, through the plurality of sand fills 53, 53', 59, and 510, through the screened casing 52 and into its interior where it is available for sampling and analysis by any mode or means known and desired.

It is understood by a person skilled in the art that the incremental distances normally are about equal to, or slightly less, than the length of the standard length of a disconnectable segment of the drill casing 51, but that this is not an inflexible requirement; the incremental distances each may be adjusted in length to adapt the methodology to the circumstances of a particular condition or circumstance. A plurality of incremental distances of equal lengths is preferred but not strictly required. A given sand fill preferably is controllably deposited to a height corresponding approximately to, or modestly greater than, the incremental distance of the respectively associated subsequent lift of the drill casing.

In the system of FIG. 5C, the interior of the continuously screened casing 511 is available for measurement of the surrounding formation characteristics, through the screen 511 and a subsequent another sand fill 510, of horizontal conductivity, contaminant distribution, head distribution and discrete water sample extraction using the sealing liner designs of previous patents by this inventor.

Figure 6:
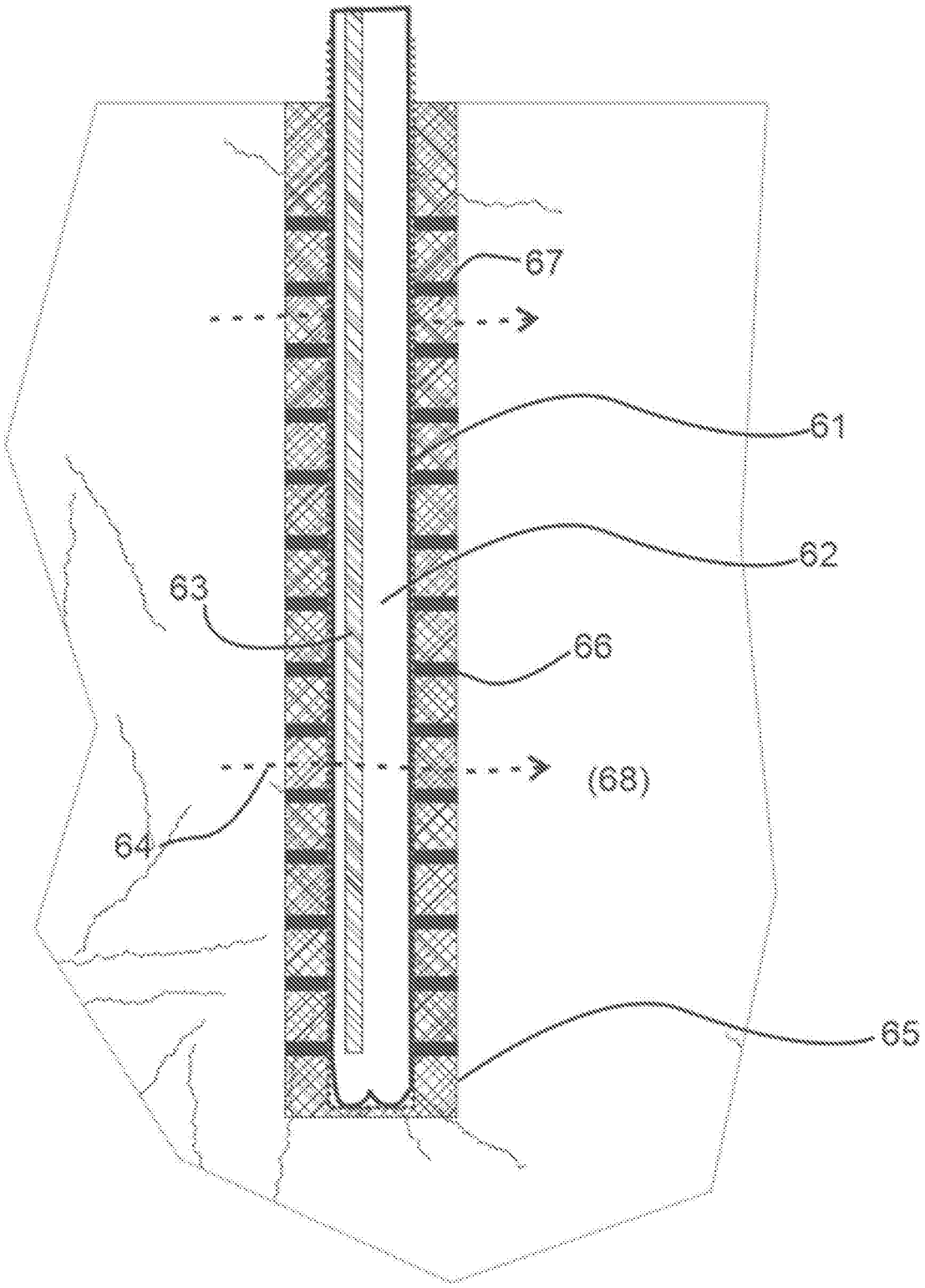
FIG. 6 is a schematic side sectional view illustrating the flow field about the casing, with the interrupted sand pack system, according to the present invention, and with an interior flexible liner with an activated carbon strip attached to the liner.

A testing liner may be installed down and within the screened casing 61 after an initial sealing liner (e.g., liner 54 in FIG. 5B) has been extracted from the screened casing. FIG. 6 depicts the continuous screened casing 61 with a flexible sealing testing liner 62 provided with an activated adsorbent carbon strip 63 on its exterior (as described, for example, in U.S. Pat. No. 7,896,578). With the testing liner 62 installed, the subterranean ambient fluid flow 64 (two instances indicated by dashed directional arrows) to and past the borehole 65 is limited to lateral (generally horizontal) flows through the plurality of sand fill layers between alternating sealing material layers along the depth of the borehole as seen in FIG. 6. Thus, due to the plurality of sealing material layers 66 in the annulus 67, undesirable vertical flows up or down within the annulus 67 is reduced or prevented. Advantageously, the carbon strip 63 can adsorb (and thereby permit mapping of) the vertical distribution of the contaminants in the formation 68 over nearly the entire length (height) of the continuous screened casing 61. Extracting the testing liner 62 permits the evaluation of the carbon strip 63 to facilitate mapping of the contaminant distribution at discrete elevations in the borehole where the carbon strip adsorbs contaminants from the ambient ground water.

In that same continuously screened well, other methods using flexible liners can be used taking advantage of the nearly continuous access to the formation for measurements of conductivity distribution, head distribution and discrete water sampling.

Figure 7:
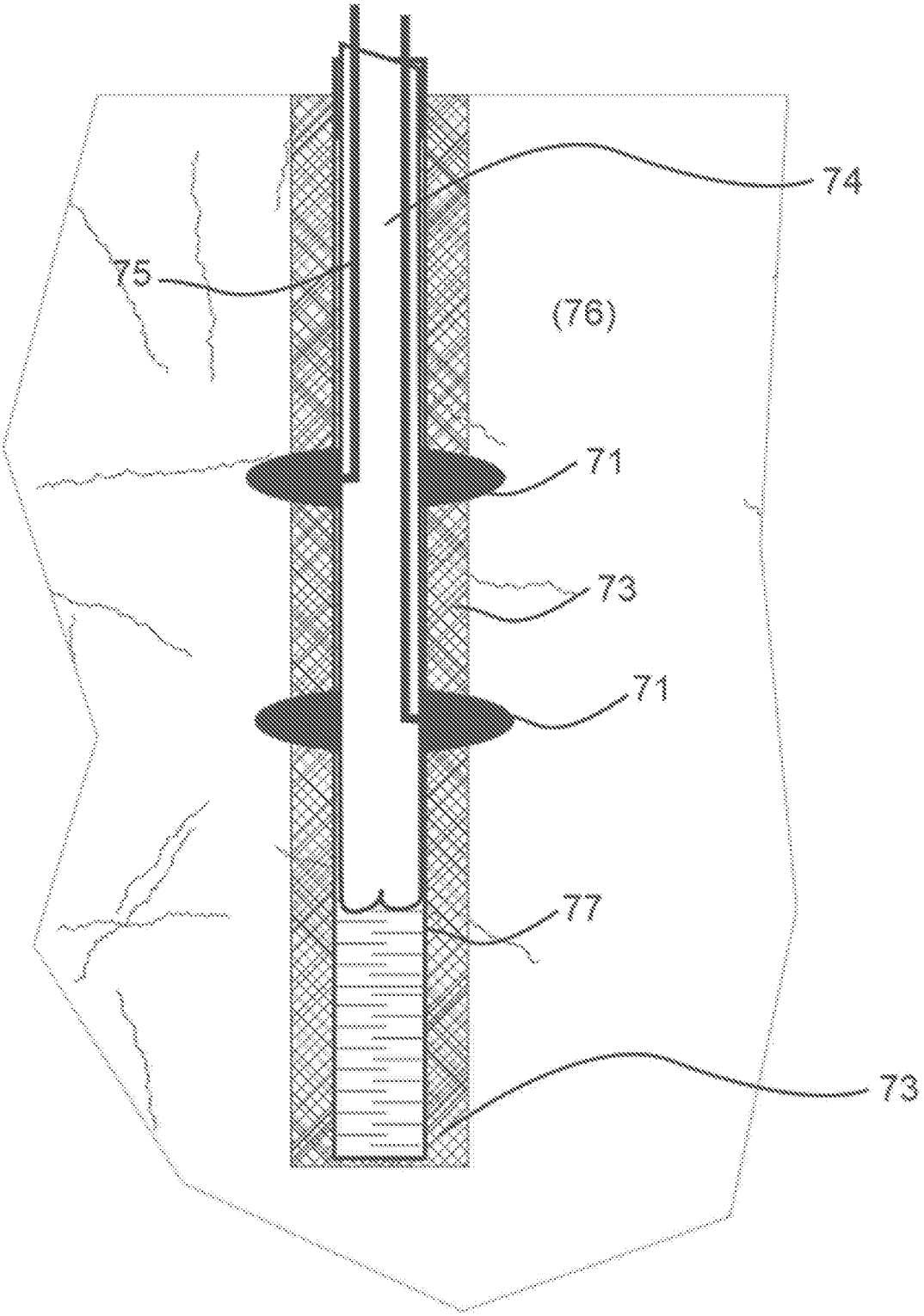
FIG. 7 is a schematic side sectional view of a system according to the present invention, as used to inject a sealant into the sand pack at predetermined intervals.

Attention is invited to FIG. 7. The backfill of the annular space between the continuously screened casing and the borehole wall can be filled only with sand, and no grout. An alternative method to provide the alternating layers of sealing material 71 in the annulus 73, after the annulus is filled only with sand, is suggested in FIG. 7. The screened casing 77 is disposed in the borehole, and the annulus 73 is filled with sand. A flexible sealing liner 74 with tubes 75 running from above ground down to one or more corresponding discrete locations is installed down and within the screened casing 77. The lower end of each tube 75 is sealed to an aperture through the liner 74, so that sealing material (e.g. fluid grout) can be pumped from aboveground down the tube and through the aperture to the exterior of the liner 74. Exiting the liner 74, the sealing material 71 enters the pore spaces of the nearby sand within the annulus 73. The several tubes 75 accordingly allow grout to be injected in measured volumes to provide discrete sealing layers at preselected elevations within the annulus 73. The injected grout may also flow a short distance into the formation 76 to reduce any fluid flow in the formation from passing the annular seals created by the sealing material 71. An advantage of a long liner 74 used for injection is that it seals the interior of the screened casing 77 for a long distance to prevent the grout flowing in the sand in the annulus 73 from reaching the interior of the casing 77 below the sealing liner 74.

A short straddle packer design (not shown) would not prevent the injected grout from flowing back into the open casing below or above the packers. The long liner can be deflated and raised to a different elevation and re-inflated to inject more sealing grout barriers in the annular sand fill. The sealing material grout may be formulated and composed with a relatively high viscosity and bentonite content in order to remain in place as the liner is moved in the casing.

The construction of a continuous screened casing with a sand pack of limited vertical conductivity and high horizontal conductivity allows the borehole well to be used for various flexible liner measurements which are normally used in stable open boreholes. With the continuous screen design, the borehole is stabilized by the screen in a formation that would otherwise cause the borehole to collapse. If a concern remains about even limited migration in the sand-filled annulus, after the detailed sampling measurements are complete, the screened casing can be filled with grout to seal the entire borehole, or can be drilled out of the ground. Even the temporary advantage of detailed mapping of hydrologic characteristics is a great advantage over cased boreholes with access to the formation at only a few screened intervals which are located with limited information on the formation characteristics. Because flexible liner measurement devices are fully removable, the screened borehole is available for discrete remediation injections using another liner device designed for discrete injections or extractions in a borehole sealed by the continuous liner. This allows a more focused injection program with less waste of injection fluids.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it shall be intended to cover with the appended claims all such modifications and equivalents. The disclosures of all United States patents cited hereinabove are expressly incorporated herein by reference.

I claim:

1. A method for providing a stable borehole in a subsurface geologic formation, to permit ground water evaluations, comprising the steps of:

(a) driving a drill casing into a subsurface of the ground to form a borehole having a bottom;

(b) removing material from an interior of the drill casing;

(c) lowering a screened casing into the interior of the drill casing;

(d) depositing a first sand fill at the bottom of the borehole and in an annulus between the drill casing and the screened casing;

(e) installing a flexible liner along an interior of the screened casing to seal temporarily the inside of the screened casing;

(f) withdrawing the drill casing upward a first incremental distance;

(g) emplacing a first layer of sealing material upon the first sand fill and within the annulus between the drill casing and the screened casing;

(h) depositing another sand fill in the annulus and upon an underlying layer of sealing material;

(i) withdrawing the drill casing upward another incremental distance;

(j) emplacing another layer of sealing material upon the another sand fill and within the annulus; and (k) repeating steps (h)-(j) a number of iterations thereby filling at least a portion of the annulus between the drill casing and the screened casing with alternating layers of sand fill and sealing material.

2. The method according to claim 1, further comprising:

extracting the flexible liner from within the screened casing; and leaving unlined screened casing in place within the borehole.

3. The method according to claim 2, further comprising:

allowing ground water to flow from the formation, between at least two layers of the sealing material and though one of the sand fills, and through the screened casing.

4. The method according to claim 3, further comprising at least one of the steps of measuring a characteristic of the formation characteristics, evaluating contaminant distribution, determining ground water head distribution, and extracting discrete water samples.

5. The method according to claim 3, further comprising:

after extracting the flexible liner from within the screened casing, installing along the interior of the screened casing a flexible testing liner with an activated adsorbent carbon strip on its exterior;

allowing ground water to flow laterally through the annulus and the screened casing to the adsorbent carbon strip;

extracting the testing liner from within the screened casing;

evaluating of the carbon strip to map the contaminant distribution at discrete elevations in the borehole.

6. The method according to claim 2 wherein the drill casing comprises a series of drill casing segments having segment lengths, and wherein depositing a first sand fill, or depositing another sand fill, comprises depositing to a height equal to a segment length.

7. The method according to claim 6 wherein the drill casing comprises a series of drill casing segments having segment lengths, and wherein withdrawing the drill casing upward a first incremental distance or another incremental distance comprises withdrawing a distance equal to a segment length.

8. The method according to claim 2 wherein the drill casing comprises a series of drill casing segments having segment lengths, and wherein withdrawing the drill casing upward a first incremental distance or another incremental distance comprises withdrawing a distance equal to a segment length.

9. The method according to claim 2 wherein emplacing a first layer of sealing material, or emplacing another layer of sealing material, comprises emplacing a grout.

10. The method according to claim 2 wherein filling at least a portion of the annulus comprises filling to a desired predetermined elevation within the borehole.

11. The method according to claim 2 further comprising permitting the layers of sealing material to invade pore space in at least one adjacent of the sand fills.

12. The method according to claim 2 further comprising:

permitting the layers of sealing material to flow into slots in the screened casing; and preventing, with the flexible liner, passage of the layers of sealing material into the interior of the screen casing.

13. The method according to claim 2 further comprising:

allowing the layers of sealing material to flow into the formation to seal the formation for a distance outward from the borehole.

14. The method according to claim 2 wherein depositing another sand fill in the annulus and upon the layer of sealing material beneath the another sand fill further comprises:

allowing the another sand fill to settle into the underlying sealing material; and thereby driving sealing material into the formation and the annulus.

15. The method according to claim 1, wherein installing a flexible liner along the interior of the screened casing comprising everting the liner.

* * * * *